US012247566B2

(12) United States Patent
Inoue

(10) Patent No.: US 12,247,566 B2
(45) Date of Patent: Mar. 11, 2025

(54) SCREW COMPRESSOR, AND REFRIGERATION APPARATUS

(71) Applicant: DAIKIN INDUSTRIES, LTD., Osaka (JP)

(72) Inventor: Takashi Inoue, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/806,237

(22) Filed: Aug. 15, 2024

(65) Prior Publication Data

US 2024/0401594 A1 Dec. 5, 2024

Related U.S. Application Data

(63) Continuation of application No. PCT/JP2023/004715, filed on Feb. 13, 2023.

(30) Foreign Application Priority Data

Feb. 22, 2022 (JP) ..... 2022-025726

(51) Int. Cl.
*F04C 18/16* (2006.01)
*F04C 2/16* (2006.01)
(Continued)

(52) U.S. Cl.
CPC ..... *F04C 18/16* (2013.01); *F04C 18/48* (2013.01); *F04C 18/50* (2013.01); *F04C 18/52* (2013.01); *F25B 31/026* (2013.01)

(58) Field of Classification Search
CPC ..... F04C 18/16; F04C 18/52; F04C 18/50; F04C 18/48; F04C 2/16
See application file for complete search history.

(56) References Cited

U.S. PATENT DOCUMENTS 4,704,069 A * 11/1987 Kocher ..... F04C 28/125 417/310
8,348,648 B2 * 1/2013 Miyamura ..... F04C 18/52 418/196

(Continued)

FOREIGN PATENT DOCUMENTS

JP 2021-162021 A 10/2021

OTHER PUBLICATIONS

International Preliminary Report of corresponding PCT Application No. PCT/JP2023/004715 dated Sep. 6, 2024.

(Continued)

*Primary Examiner* — Deming Wan
(74) *Attorney, Agent, or Firm* — GLOBAL IP COUNSELORS, LLP

(57) ABSTRACT

A screw compressor includes a screw rotor having a plurality of helical grooves, a first rotor configured to mesh with the helical grooves of the screw rotor, a second rotor configured to mesh with the helical grooves of the screw rotor, and a casing having a partition wall rotatably retaining the screw rotor and covering an outer peripheral surface of the screw rotor. The partition wall includes first and second envelope portions to form first and second compression chambers. The first compression chamber compresses a fluid introduced into the casing with a suction pressure to an intermediate pressure higher than the suction pressure. The second compression chamber compresses the fluid with the intermediate pressure to a discharge pressure higher than the intermediate pressure.

12 Claims, 12 Drawing Sheets

(51) Int. Cl.

| | |
|---|---|
| ***F04C 18/18*** | (2006.01) |
| ***F04C 18/48*** | (2006.01) |
| ***F04C 18/50*** | (2006.01) |
| ***F04C 18/52*** | (2006.01) |
| ***F25B 31/02*** | (2006.01) |

(56) References Cited

U.S. PATENT DOCUMENTS

| | | | | |
|---|---|---|---|---|
| 11,174,862 | B2 * | 11/2021 | Miyamura ..... | F04C 29/06 |
| 2010/0260639 | A1 * | 10/2010 | Hossain ..... | F01C 17/02 418/201.1 |
| 2023/0015175 | A1 | 1/2023 | Fukuda et al. | |

OTHER PUBLICATIONS

International Search Report of corresponding PCT Application No. PCT/JP2023/004715 dated May 9, 2023.

* cited by examiner

SCREW COMPRESSOR, AND REFRIGERATION APPARATUS

CROSS-REFERENCE TO RELATED APPLICATIONS

This is a continuation of International Application No. PCT/JP2023/004715 filed on Feb. 13, 2023, which claims priority to Japanese Patent Application No. 2022-025726, filed on Feb. 22, 2022. The entire disclosures of these applications are incorporated by reference herein.

BACKGROUND

Technical Field

The present disclosure relates to a screw compressor and a refrigeration apparatus.

Background Art

Japanese Unexamined Patent Publication No. 2021-162021 discloses a screw compressor having a first compression chamber where a fluid with a suction pressure is compressed to an intermediate pressure, and a second compression chamber where the fluid with the intermediate pressure is compressed to a discharge pressure. The first compression chamber and the second compression chamber are formed between a single screw rotor and a plurality of gates.

SUMMARY

A first aspect of the present disclosure is directed to a screw compressor including: a screw rotor (40) having a plurality of helical grooves (41); a first rotor (31) configured to mesh with the helical grooves (41) of the screw rotor (40); a second rotor (32) configured to mesh with the helical grooves (41) of the screw rotor (40); and a casing (10) having a partition wall (15), the partition wall (15) rotatably retaining the screw rotor (40) and covering an outer peripheral surface of the screw rotor (40), wherein the partition wall (15) includes a first envelope portion (11) to form a first compression chamber (21), and a second envelope portion (12) to form a second compression chamber (22), the first compression chamber (21) is formed inside the first envelope portion (11) by the screw rotor (40) and the first rotor (31), the first compression chamber (21) compressing a fluid introduced into the casing (10) with a suction pressure to an intermediate pressure higher than the suction pressure, the second compression chamber (22) is formed inside the second envelope portion (12) by the screw rotor (40) and the second rotor (32), the second compression chamber (22) compressing the fluid with the intermediate pressure to a discharge pressure higher than the intermediate pressure, and an axial length (D1) of the first envelope portion (11) and an axial length (D2) of the second envelope portion (12) that extend along a drive shaft (25) of the screw rotor (40) are different from each other.

DETAILED DESCRIPTION OF EMBODIMENT(S)

First Embodiment

Figure 1:
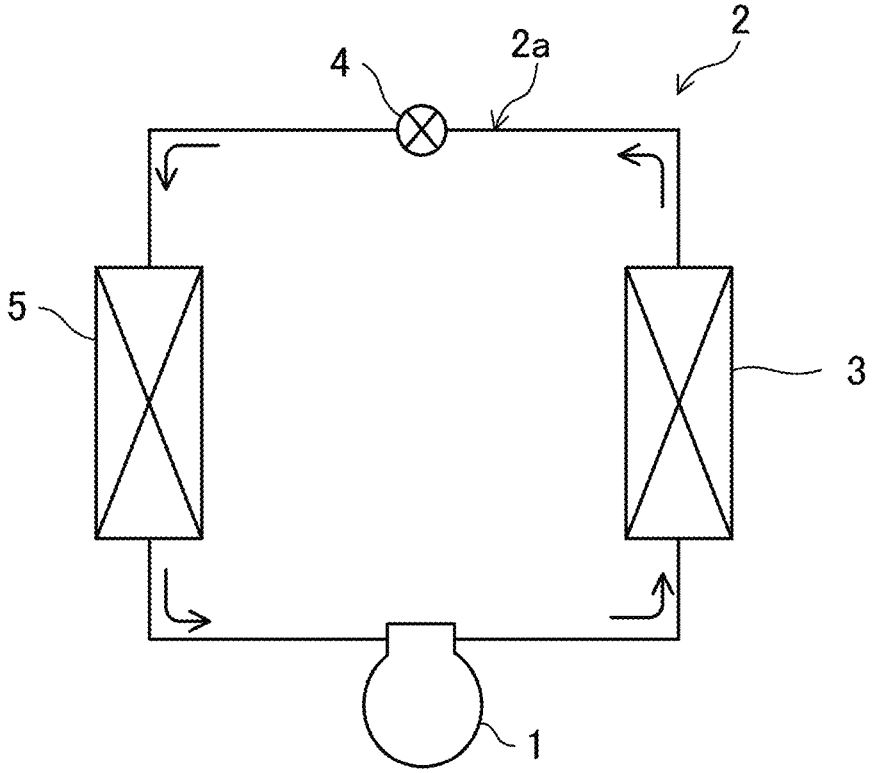
FIG. 1 is a refrigerant circuit diagram illustrating a configuration of a refrigeration apparatus according to a first embodiment.

As illustrated in FIG. 1, a screw compressor (1) is provided in a refrigeration apparatus (2). The refrigeration apparatus (2) includes a refrigerant circuit (2*a*) filled with a refrigerant. The refrigerant circuit (2*a*) has a screw compressor (1), a radiator (3), a decompression mechanism (4), and an evaporator (5). The decompression mechanism (4) is, for example, an expansion valve. The refrigerant circuit (2*a*) performs a vapor compression refrigeration cycle.

The refrigeration apparatus (2) is an air conditioner. The air conditioner may be a cooling-only apparatus, a heating-only apparatus, or an air conditioner switchable between cooling and heating. In this case, the air conditioner has a switching mechanism (e.g., a four-way switching valve) configured to switch the direction of circulation of the refrigerant. The refrigeration apparatus (2) may be a water heater, a chiller unit, or a cooling apparatus configured to cool air in an internal space. The cooling apparatus cools the air in a refrigerator, a freezer, or a container, for example.

Figure 2:
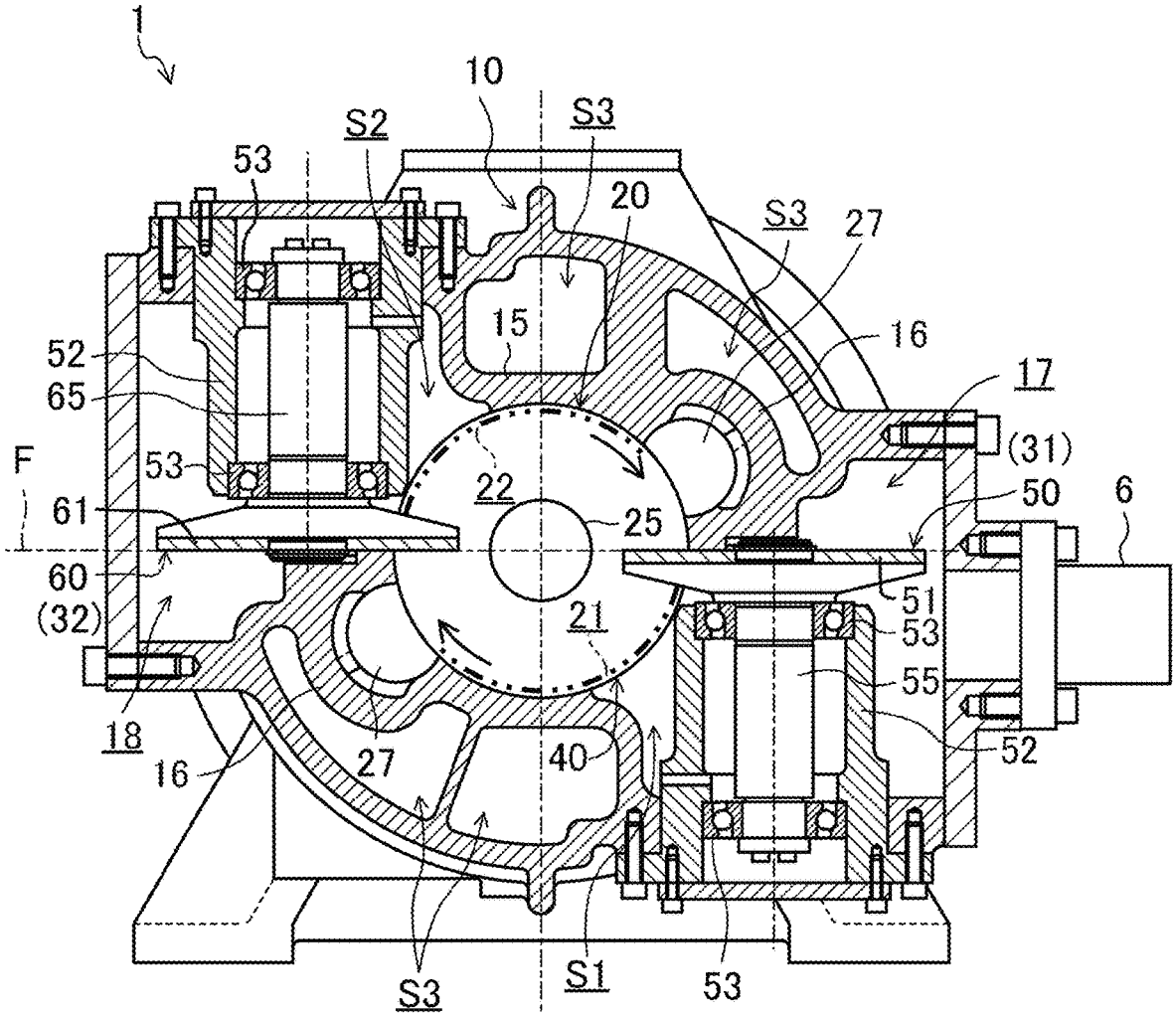
FIG. 2 is a cross-sectional view of a configuration of a screw compressor as viewed from the back side.
Figure 3:
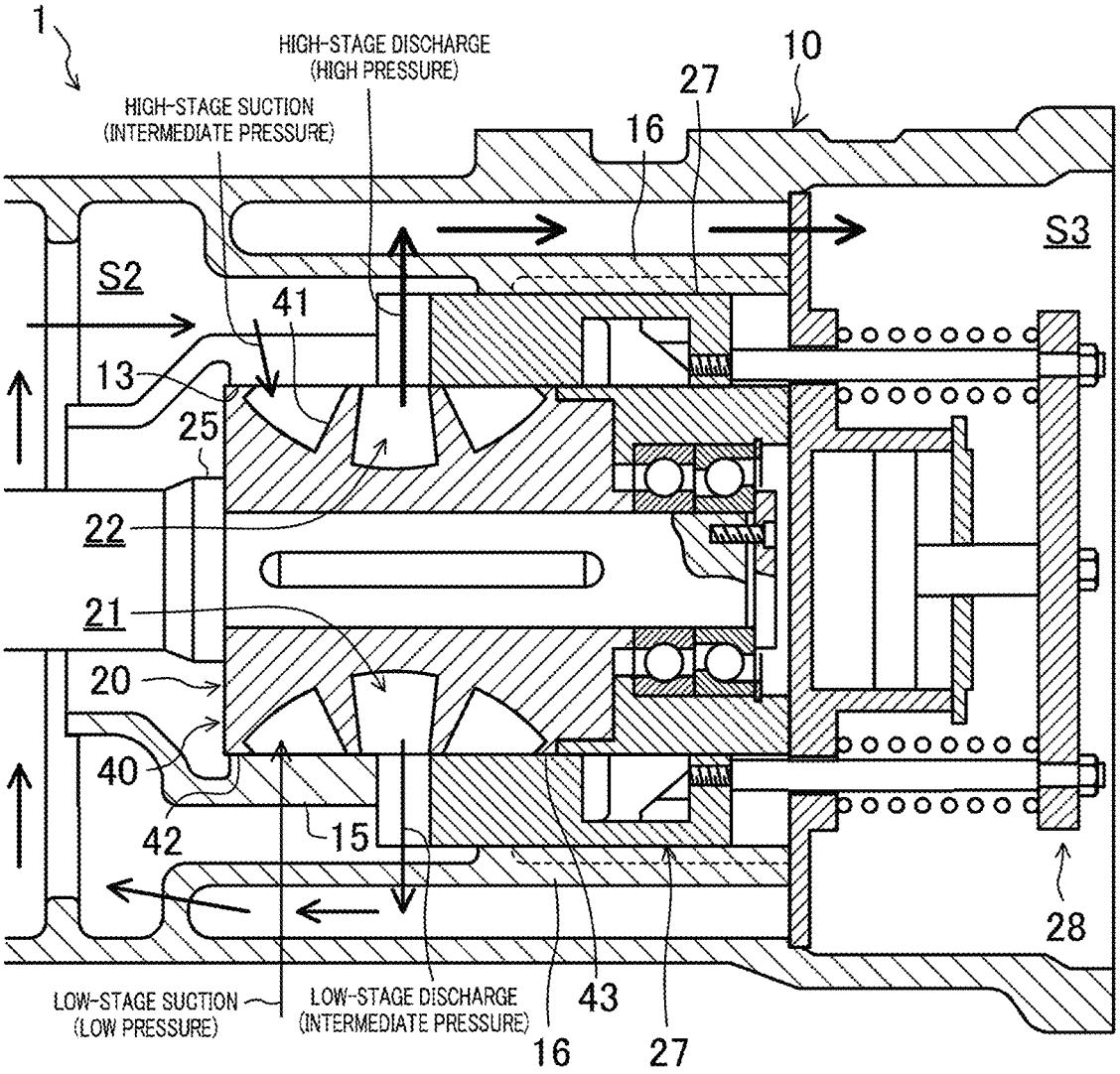
FIG. 3 is a sectional side view of the configuration of the screw compressor.

As illustrated in FIGS. 2 and 3, the screw compressor (1) includes a casing (10) and a compression mechanism (20). The casing (10) houses the compression mechanism (20). The compression mechanism (20) is coupled to a motor (not shown) via a drive shaft (25).

The casing (10) includes therein a low-pressure space (S1) into which a low-pressure refrigerant flows, an intermediate-pressure space (S2) into which an intermediate-pressure refrigerant with a pressure higher than that of the low-pressure refrigerant flows, and a high-pressure space (S3) into which a high-pressure refrigerant with a pressure higher than that of the intermediate-pressure refrigerant flows.

The compression mechanism (20) has a partition wall (15) provided in the casing (10), one screw rotor (40), a first rotor (31), and a second rotor (32).

The partition wall (15) is cylindrical. The screw rotor (40) is fitted into the partition wall (15). The partition wall (15) covers the outer peripheral surface of the screw rotor (40). The first rotor (31) and the second rotor (32) pass through the partition wall (15) to mesh with the screw rotor (40).

The screw rotor (40) is a metal member having a generally columnar shape. The outer diameter of the screw rotor (40) is set to be slightly smaller than the inner diameter of the partition wall (15). The outer peripheral surface of the screw rotor (40) is close to the inner peripheral surface of the partition wall (15).

An outer periphery of the screw rotor (40) has a plurality of helical grooves (41) extending helically. The helical grooves (41) extend from one axial end toward the other axial end of the screw rotor (40). A first end portion (42) and a second end portion (43) are provided at respective ends of the screw rotor (40) in the axial direction. Each of the first end portion (42) and the second end portion has a smooth cylindrical outer peripheral surface without any helical grooves (41). The helical grooves (41) of the screw rotor (40) are formed between the first end portion (42) and the second end portion (43) of the screw rotor (40). The drive shaft (25) is coupled to the screw rotor (40). The drive shaft (25) and the screw rotor (40) rotate together.

As illustrated in FIG. 2, the first rotor (31) is configured as a first gate rotor (50). The first gate rotor (50) has first gates (51), which are a plurality of teeth arranged radially. The first gates (51) mesh with the helical grooves (41) of the screw rotor (40). The first gate rotor (50) is housed in a first gate rotor chamber (17). The first gate rotor chamber (17) is defined in the casing (10), and is adjacent to the partition wall (15).

The second rotor (32) is configured as a second gate rotor (60). The second gate rotor (60) has second gates (61), which are a plurality of teeth arranged radially. The second gates (61) mesh with the helical grooves (41) of the screw rotor (40). The second gate rotor (60) is housed in a second gate rotor chamber (18). The second gate rotor chamber (18) is defined in the casing (10), and is adjacent to the partition wall (15).

In the compression mechanism (20), a space surrounded by the inner peripheral surface of a first envelope portion (11) of the partition wall (15), which will be described later, the helical grooves (41) of the screw rotor (40), and the first gates (51) of the first gate rotor (50) is a first compression chamber (21).

In the compression mechanism (20), a space surrounded by the inner peripheral surface of a second envelope portion (12) of the partition wall (15), which will be described later, the helical grooves (41) of the screw rotor (40), and the second gates (61) of the second gate rotor (60) is a second compression chamber (22).

A bearing housing (52) is provided in the first gate rotor chamber (17). The bearing housing (52) includes a ball bearing (53). A first shaft (55) of the first gate rotor (50) is rotatably supported via the ball bearing (53).

Another bearing housing (52) is provided in the second gate rotor chamber (18). The bearing housing (52) includes a ball bearing (53). A second shaft (65) of the second gate rotor (60) is rotatably supported via the ball bearing (53).

The first shaft (55) of the first gate rotor (50) and the second shaft (65) of the second gate rotor (60) are substantially orthogonal to a phantom plane (F) extending along the drive shaft (25) of the screw rotor (40) (see FIG. 2). Specifically, the first gates (51) of the first gate rotor (50) and the second gates (61) of the second gate rotor (60) are arranged on the same phantom plane (F).

Thus, in machining the casing (10) using a machine tool (not shown), a setup change process is not needed, in which the casing (10) retained by the machine tool is removed temporarily for adjustment of the retaining posture, resulting in an improvement in the working efficiency.

Specifically, a case of moving a rotary tool (not shown) of a machine tool toward the casing (10) from the front to the back of the sheet of FIG. 2 will be described. In this case, a hole for the screw rotor (40) is formed in the casing (10) using the rotary tool, and then a retaining table (not shown) of the machine tool is rotated 90° toward the front while retaining the casing (10). Accordingly, the first shaft (55) of the first gate rotor (50) and the second shaft (65) of the second gate rotor (60) are oriented toward the front side of the sheet of FIG. 2. It is thus possible to form a hole for each of the first gate rotor (50) and the second gate rotor (60) by simply moving the rotary tool from the front to the back of the sheet of FIG. 2, without changing the posture of the casing (10) retained. As a result, the accuracy in machining the casing (10) can be ensured.

Slide Valve

As illustrated in FIG. 3, the screw compressor (1) is provided with slide valves (27). Each of the slide valves (27) is housed in a corresponding one of valve storing portions (16) which are portions of the partition wall (15) protruding radially outward at two circumferential portions of the partition wall (15) (see FIG. 2).

The slide valves (27) are slidable along the axis of the partition wall (15). The slide valves (27) face the outer peripheral surface of the screw rotor (40) when inserted in the corresponding valve storing portions (16). The screw compressor (1) is provided with a driving mechanism (28) configured to drive and slide the slide valves (27).

The slide valves (27) are valves, the positions of which are adjustable in the axial direction of the screw rotor (40). The slide valves (27) can be used as an unloading mechanism configured to return the refrigerant that is being compressed in the first compression chamber (21) or the second compression chamber (22) toward the suction side to change the operating capacity. The slide valves (27) can also be used as a compression ratio regulation mechanism configured to adjust the timing when the refrigerant is discharged from the first compression chamber (21) or the second compression chamber (22) to regulate the compression ratio (internal volume ratio).

The partition wall (15) is provided with fixed discharge ports (not shown) which always communicate with the first compression chamber (21) and the second compression chamber (22), regardless of the positions of the slide valves (27).

First Compression Chamber and Second Compression Chamber

The first compression chamber (21) is a compression chamber on a low-stage side in two-stage compression, and compresses the refrigerant introduced into the casing (10) at a suction pressure to an intermediate pressure higher than the suction pressure. The second compression chamber (22) is a compression chamber on a high-stage side in the two-stage compression, and compresses the refrigerant at the intermediate pressure to a discharge pressure higher than the intermediate pressure.

The casing (10) includes therein the low-pressure space (S1) communicating with the suction side of the first compression chamber (21), the intermediate-pressure space (S2) communicating with the discharge side of the first compression chamber (21) and the suction side of the second compression chamber (22), and the high-pressure space (S3) communicating with the discharge side of the second compression chamber (22).

Specifically, a low-pressure pipe (6) through which a low-pressure refrigerant flows is connected to the first gate rotor chamber (17). The low-pressure refrigerant is supplied to the first gate rotor chamber (17) from the low-pressure pipe (6), and the first gate rotor chamber (17) thus serves as the low-pressure space (S1). The first gate rotor chamber (17) is configured to supply the low-pressure refrigerant to the suction opening of the first compression chamber (21). The low-pressure refrigerant is compressed in the first compression chamber (21) to be an intermediate-pressure refrigerant.

The intermediate-pressure refrigerant compressed in the first compression chamber (21) to the intermediate pressure is supplied to the second gate rotor chamber (18) through a space where the motor (not shown) is arranged. The intermediate-pressure refrigerant is supplied to the second gate rotor chamber (18), and the second gate rotor chamber (18) thus serves as the intermediate-pressure space (S2).

Figure 4:
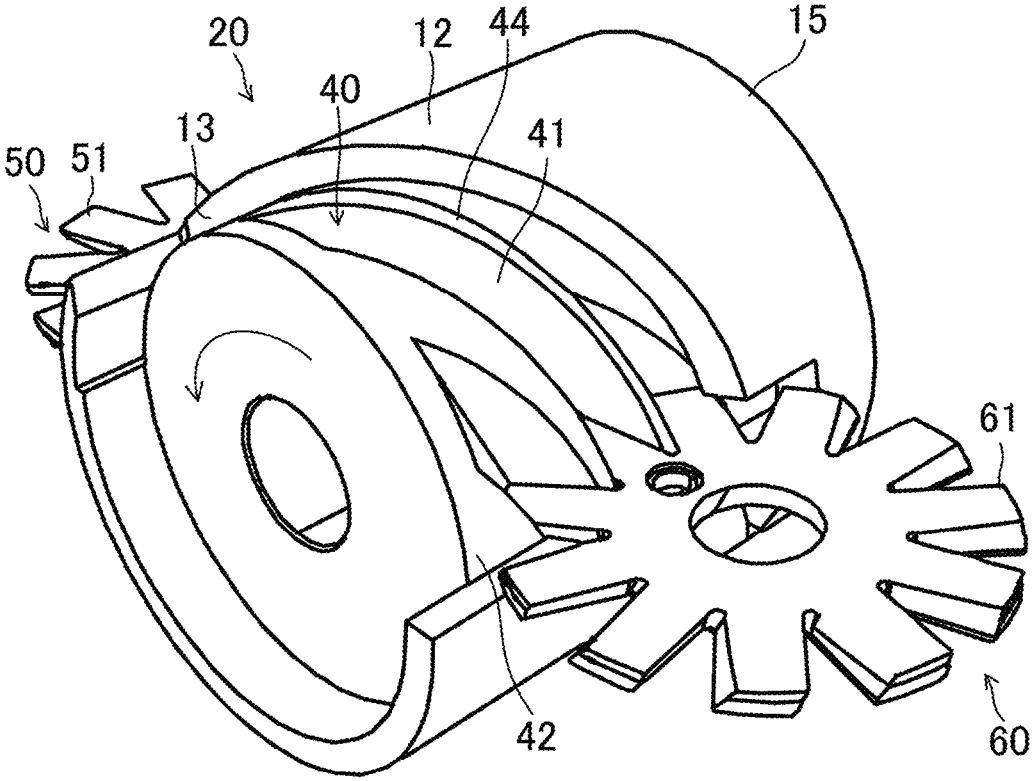
FIG. 4 is a perspective view illustrating a configuration of a compression mechanism.

An axial end portion of the partition wall (15) near the intermediate-pressure space (S2) has a cut-out (13) (see FIG. 4 as well). The cut-out (13) is formed by cutting out a portion of the partition wall (15). The intermediate-pressure space (S2) and the second compression chamber (22) communicate with each other through the cut-out (13). An oil film is formed between the first end portion (42) of the screw rotor (40) and the partition wall (15). The oil film reduces the circulation of the refrigerant between the partition wall (15) and the first compression chamber (21) of the screw rotor (40).

The intermediate-pressure refrigerant flowing through the intermediate-pressure space (S2) is supplied through the cut-out (13) of the partition wall (15) to the suction opening of the second compression chamber (22). The intermediate-pressure refrigerant is compressed in the second compression chamber (22) to be a high-pressure refrigerant.

The high-pressure refrigerant compressed in the second compression chamber (22) to the high pressure is supplied to the high-pressure space (S3). The high-pressure refrigerant flowing through the high-pressure space (S3) is discharged from a discharge port (not shown) of the casing (10).

As described above, the low-pressure space (S1), the first compression chamber (21), the intermediate-pressure space (S2), the second compression chamber (22), and the high-pressure space (S3) are connected together in the order of the pressure of the fluid from low pressure to high pressure.

First Envelope Portion and Second Envelope Portion

Figure 5:
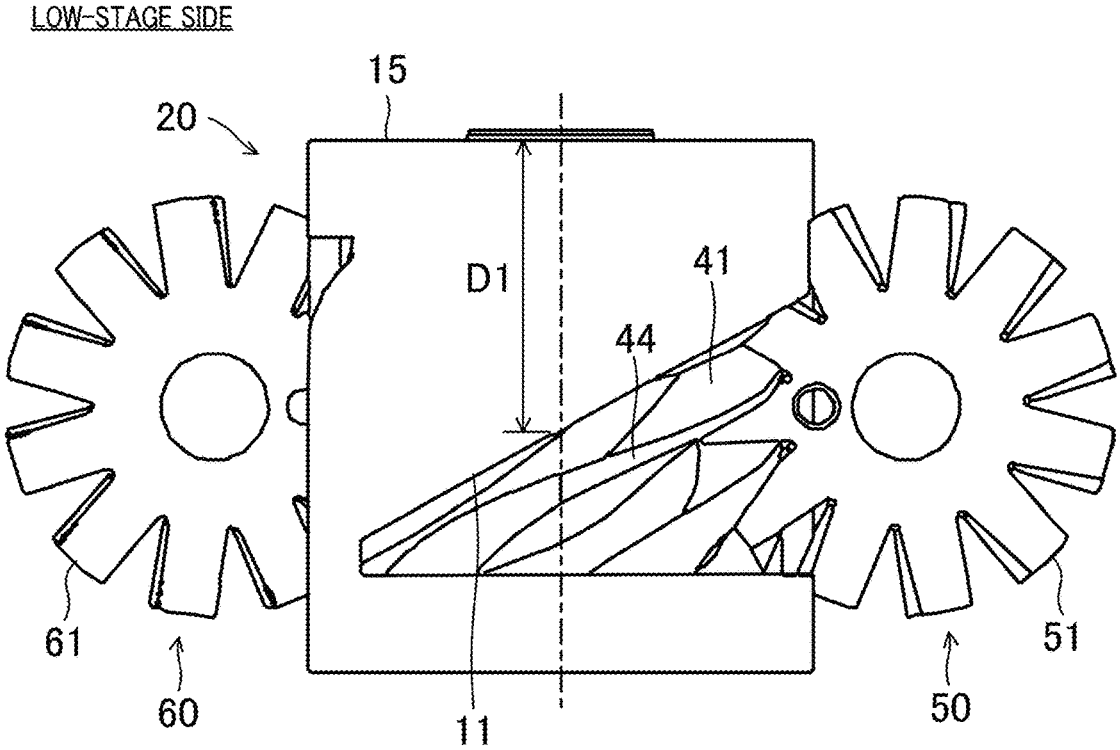
FIG. 5 is a plan view illustrating a configuration of a first envelope portion.
Figure 6:
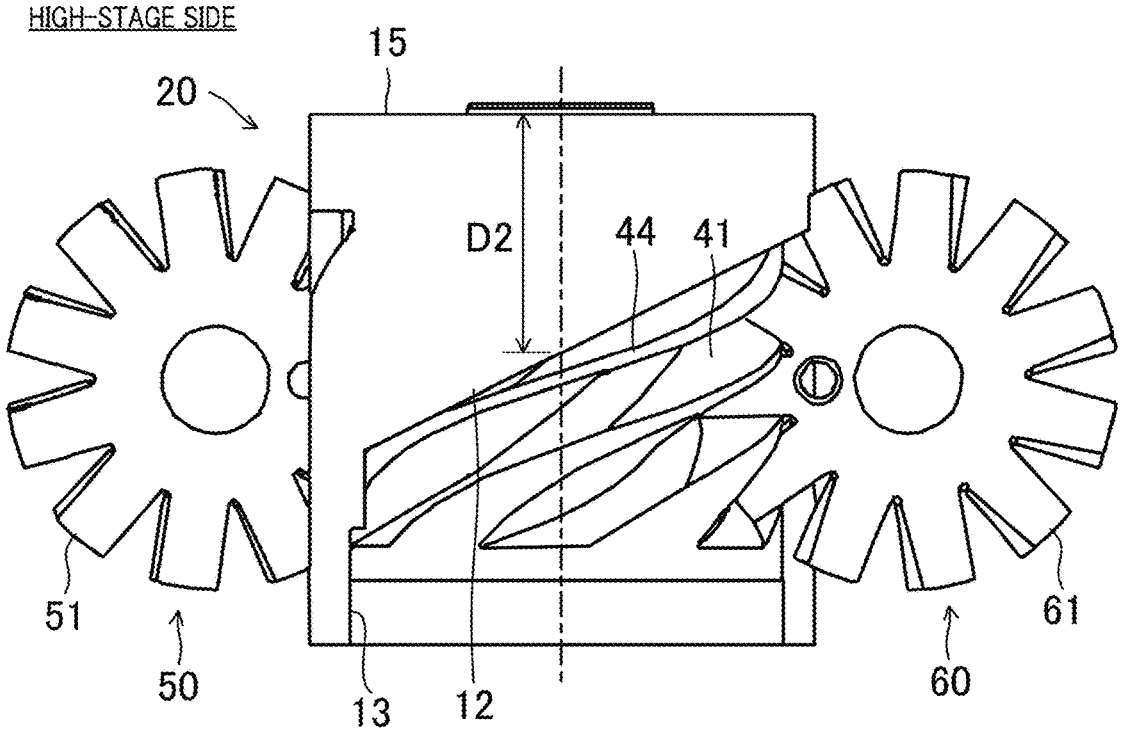
FIG. 6 is a plan view illustrating a configuration of a second envelope portion.

As illustrated in FIGS. 5 and 6, the partition wall (15) includes the first envelope portion (11) and the second envelope portion (12). The first envelope portion (11) is configured to isolate the first compression chamber (21) from the low-pressure space (S1) on its outer peripheral side before the first compression chamber (21) reaches, during the rotation of the screw rotor (40), a suction shut-off position where the first compression chamber (21) is fully closed by the first gate rotor (50).

An edge portion of the first envelope portion (11) is shaped to draw a curve parallel to the edge portion of a circumferential sealing surface (44) of the screw rotor (40). In other words, the edge portion of the first envelope portion (11) is shaped so that the entire length of the edge portion can overlap with the circumferential sealing surface (44) which moves along with the rotation of the screw rotor (40).

The second envelope portion (12) is configured to isolate the second compression chamber (22) from the intermediate-pressure space (S2) on its outer peripheral side before the second compression chamber (22) reaches, during the rotation of the screw rotor (40), a suction shut-off position where the second compression chamber (22) is fully closed by the second gate rotor (60).

An edge portion of the second envelope portion (12) is shaped to draw a curve parallel to the edge portion of the circumferential sealing surface (44) of the screw rotor (40). In other words, the edge portion of the second envelope portion (12) is shaped so that the entire length of the edge portion can overlap with the circumferential sealing surface (44) which moves along with the rotation of the screw rotor (40).

In this embodiment, the axial length (D1) of the first envelope portion (11) and the axial length (D2) of the second envelope portion (12) that extend along the drive shaft (25) of the screw rotor (40) are set to be different from each other. Specifically, the axial length (D1) of the first envelope portion (11) is greater than the axial length (D2) of the second envelope portion (12).

Thus, the timing when the first compression chamber (21) is fully closed by the first gate rotor (50) is earlier than the timing when the second compression chamber (22) is fully closed by the second gate rotor (60). As a result, the volume of the first compression chamber (21) is greater than the volume of the second compression chamber (22). It is preferable that the axial length (D1) of the first envelope portion (11) and the axial length (D2) of the second envelope portion (12) are set such that the volume of the first compression chamber (21) is about two to three times the volume of the second compression chamber (22).

As can be seen, it is possible to set the volume ratio between the first compression chamber (21) and the second compression chamber (22) appropriately by changing the timing of full closure of the first compression chamber (21) and the timing of full closure of the second compression chamber (22).

Operation

Phases of Suction, Compression, and Discharge

When the screw rotor (40) rotates, the first gate rotor (50) and the second gate rotor (60) meshing with the helical grooves (41) rotate. Thus, the compression mechanism (20) continuously repeats a suction phase, a compression phase, and a discharge phase.

Figure 7:
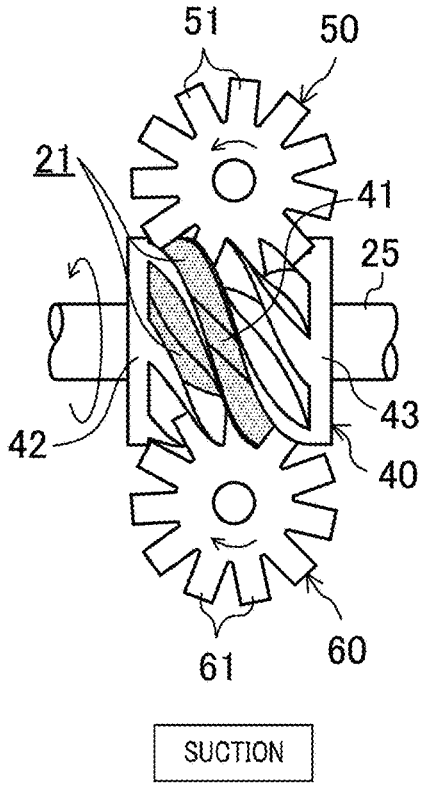
FIG. 7 is a plan view illustrating a suction phase of the screw compressor.

In the suction phase illustrated in FIG. 7, the shaded first compression chamber (21) communicates with the space on the suction side. The helical groove (41) corresponding to the first compression chamber (21) meshes with the first gate (51) of the first gate rotor (50). When the screw rotor (40) rotates, the first gate (51) relatively moves toward the terminal end of the helical groove (41), causing the volume of the first compression chamber (21) to increase. As a result, the refrigerant is sucked into the first compression chamber (21).

Figure 8:
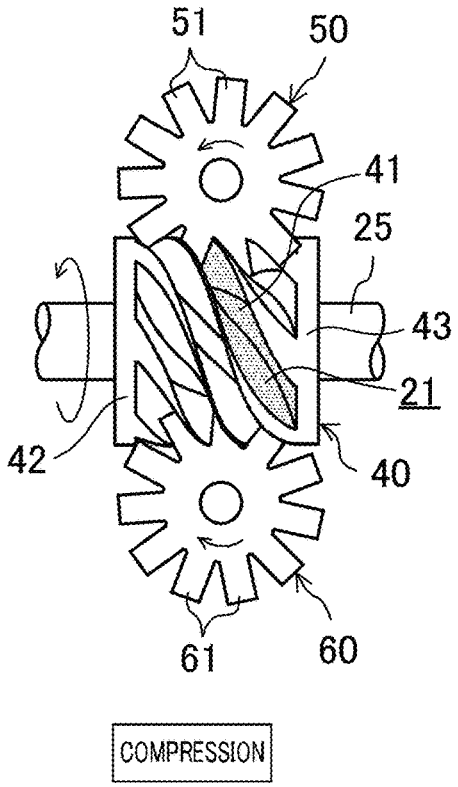
FIG. 8 is a plan view illustrating a compression phase of the screw compressor.

When the screw rotor (40) further rotates, the compression phase illustrated in FIG. 8 is performed. In the compression phase, the shaded first compression chamber (21) is fully closed. That is, the helical groove (41) corresponding to the first compression chamber (21) is separated, by the first gate (51), from the space on the suction side. As the first gate (51) approaches the terminal end of the helical groove (41) in accordance with the rotation of the screw rotor (40), the volume of the first compression chamber (21) gradually decreases. As a result, the refrigerant in the first compression chamber (21) is compressed.

Figure 9:
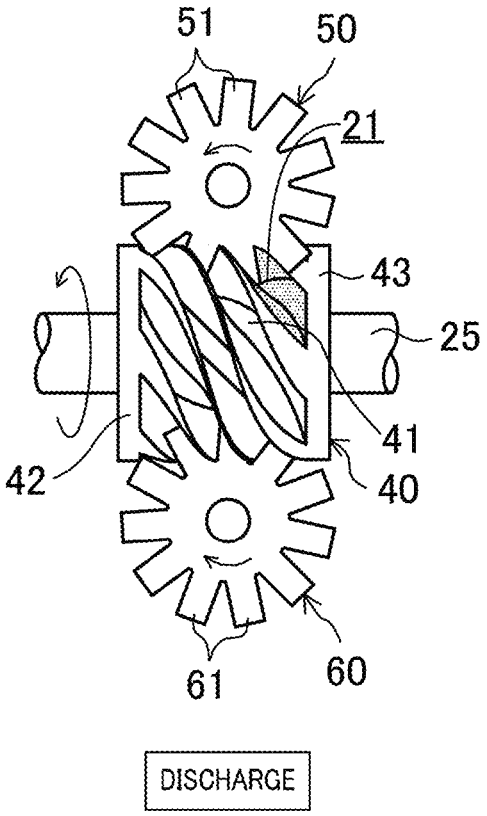
FIG. 9 is a plan view illustrating a discharge phase of the screw compressor.

When the screw rotor (40) further rotates, the discharge phase illustrated in FIG. 9 is performed. In the discharge phase, the shaded first compression chamber (21) communicates with the fixed discharge port via the end portion on the discharge side (right end portion in the figure). When the first gate (51) approaches the terminal end of the helical groove (41) in accordance with the rotation of the screw rotor (40), the refrigerant that has been compressed is pushed out of the first compression chamber (21) through the fixed discharge port to the space on the discharge side.

The suction phase, the compression phase, and the discharge phase in the high-stage second compression chamber (22) are similar to those in the low-stage first compression chamber (21), and thus will not be described.

Timing of Full Closure

The difference between the timing of full closure of the first compression chamber (21) and the timing of full closure of the second compression chamber (22) will now be described.

Figure 10:
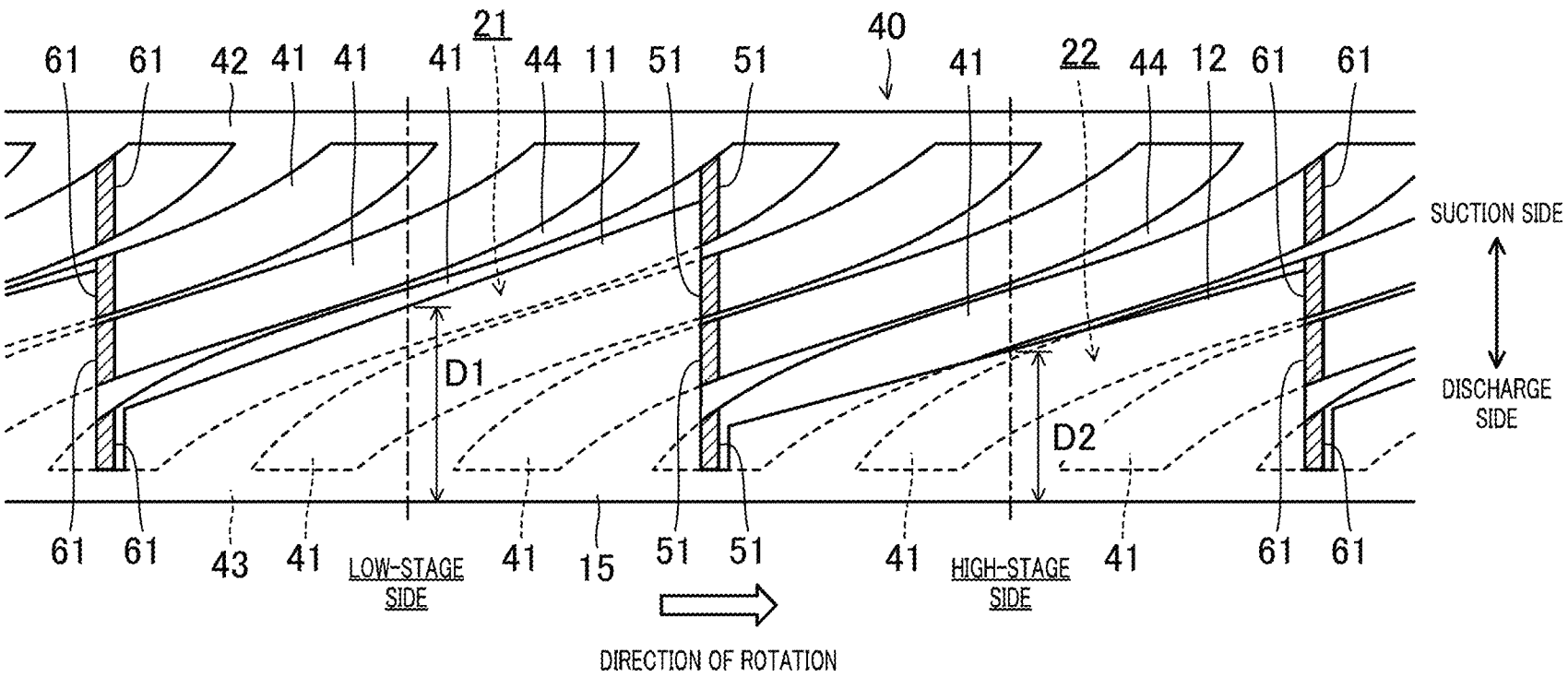
FIG. 10 is a developed view of a screw rotor and a partition wall, illustrating the state before the first compression chamber and the second compression chamber are fully closed.

Focus is given to one of the helical grooves (41) forming the first compression chamber (21) in the suction phase as illustrated in FIG. 10. A portion of the helical groove (41) is covered with the first envelope portion (11), and the remaining portion faces the low-pressure space (S1). The first gate (51) enters the helical groove (41) from the starting end of the helical groove (41). In the state illustrated in FIG. 10, the first compression chamber (21) in the suction phase formed by the helical groove (41) communicates with the low-pressure space (S1) on the outer peripheral side of the screw rotor (40). In this state, the low-pressure refrigerant flows into the first compression chamber (21) from the outer peripheral side of the screw rotor (40).

Figure 11:
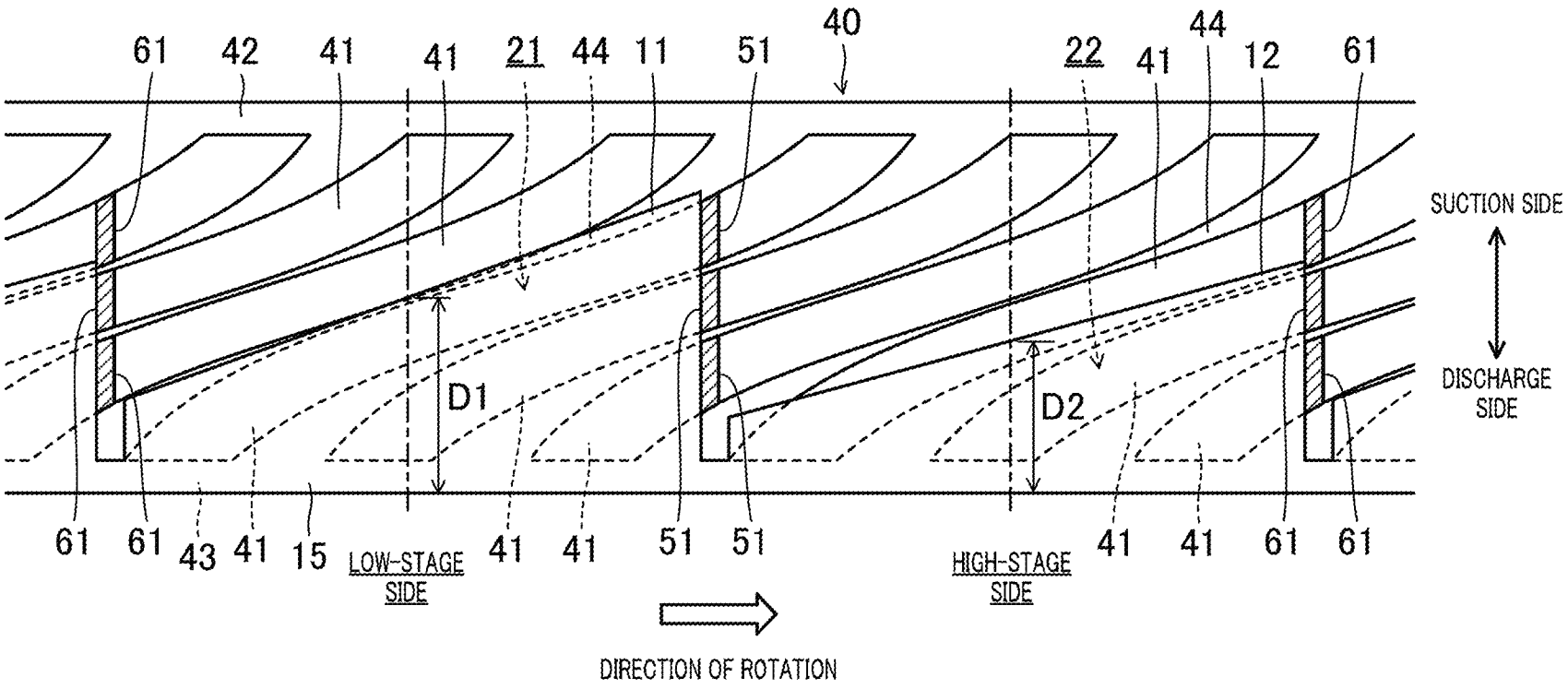
FIG. 11 is a developed view of the screw rotor and the partition wall, illustrating the state in which the first compression chamber and the second compression chamber are fully closed.

FIG. 11 is the state after further rotation of the screw rotor (40) from the state illustrated in FIG. 10. In the state illustrated in FIG. 11, the first gate (51) that has entered the helical groove (41) is in sliding contact with the groove wall and the groove bottom of the helical groove (41). The circumferential sealing surface (44) of the screw rotor (40) overlaps with the first envelope portion (11).

Thus, the first compression chamber (21) turns into a closed space separated from the low-pressure space (S1) by both the first envelope portion (11) and the first gate (51), and the suction phase ends. This position is referred to as a "suction shut-off position."

As can be seen, the first compression chamber (21) in the suction phase moves from a position at which the helical groove (41) faces the low-pressure space (S1) to a position at which the helical groove (41) is covered with the first envelope portion (11), resulting in separation from the low-pressure space (S1). At the same time, the first gate (51) separates the helical groove (41) from the low-pressure space (S1). In the screw compressor (1), the shape of the first envelope portion (11) is determined so that the refrigerant in the first compression chamber (21) flows out to the low-pressure space (S1) before the first envelope portion (11) reaches the suction shut-off position.

Similarly, in the state illustrated in FIG. 11, the second compression chamber (22) also turns into a closed space separated from the intermediate-pressure space (S2) by both the second envelope portion (12) and the second gate (61), and the suction phase ends.

As can be seen, the second compression chamber (22) in the suction phase moves from a position at which the helical groove (41) faces the intermediate-pressure space (S2) to a position at which the helical groove (41) is covered with the second envelope portion (12), resulting in separation from the intermediate-pressure space (S2). At the same time, the second gate (61) separates the helical groove (41) from the intermediate-pressure space (S2). In the screw compressor (1), the shape of the second envelope portion (12) is determined so that the refrigerant in the second compression chamber (22) flows out to the intermediate-pressure space (S2) before the second envelope portion (12) reaches the suction shut-off position.

Here, the axial length (D1) of the first envelope portion (11) is greater than the axial length (D2) of the second envelope portion (12). Thus, the timing of full closure of the first compression chamber (21) is earlier than the timing of full closure of the second compression chamber (22).

Advantages of First Embodiment

According to a feature of this embodiment, the axial length (D1) of the first envelope portion (11) is different from the axial length (D2) of the second envelope portion (12). It is thus possible to set the volume ratio between the first compression chamber (21) and the second compression chamber (22) appropriately by changing the timing of full closure of the first compression chamber (21) and the timing of full closure of the second compression chamber (22).

According to a feature of this embodiment, it is possible to set the volume ratio between the first compression chamber (21) and the second compression chamber (22) appropriately in the screw compressor including the single screw rotor (40), the first gate rotor (50), and the second gate rotor (60).

According to a feature of this embodiment, the first shaft (55) of the first gate rotor (50) and the second shaft (65) of the second gate rotor (60) are substantially orthogonal to the phantom plane (F) extending along the drive shaft (25) of the screw rotor (40). It is thus possible to form a hole for supporting the shaft of each of the screw rotor (40), the first gate rotor (50), and the second gate rotor (60) while relatively moving the rotary tool of the machine tool in one direction, without changing the posture of the casing (10) retained. The accuracy in machining the casing (10) can thus be ensured.

According to a feature of this embodiment, a refrigeration apparatus includes the screw compressor (1) and the refrigerant circuit (2*a*) through which the refrigerant compressed by the screw compressor (1) flows. It is thus possible to provide the refrigeration apparatus (2) including the screw compressor (1).

Second Embodiment

In the following description, the same reference characters designate the same components as those of the first embodiment, and the description will be focused only on the differences.

Figure 12:
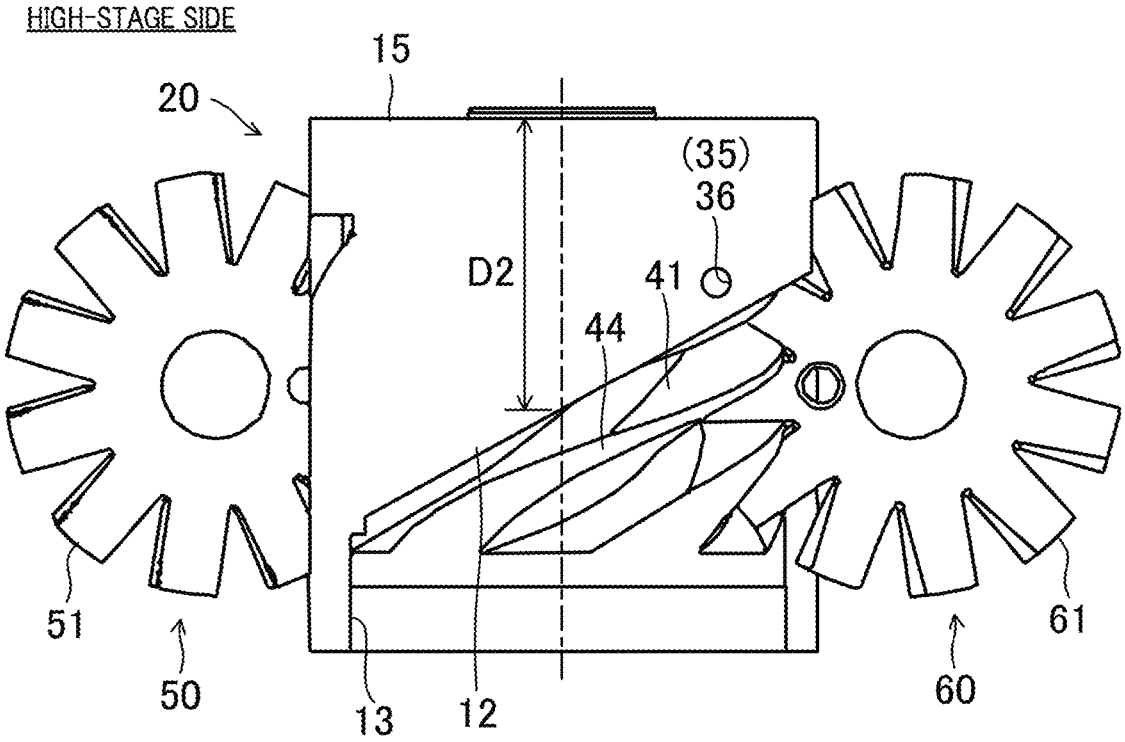
FIG. 12 is a plan view illustrating a configuration of a second envelope portion in a screw compressor according to a second embodiment.

In the example illustrated in FIG. 12, the axial length (D2) of the second envelope portion (12) is set to be equal to the axial length (D1) of the first envelope portion (11) (see FIG. 5).

The second envelope portion (12) has an opening (35) passing through the second envelope portion (12) from the inner surface to the outer surface of the second envelope portion (12). The opening (35) is a through hole (36) formed in the second envelope portion (12). The through hole (36) is formed at a position in an edge portion of the second envelope portion (12) near the second gate rotor (60).

Here, the refrigerant flows out to the intermediate-pressure space (S2) from the through hole (36) even when the second compression chamber (22) in the suction phase moves from a position at which the helical groove (41) faces the intermediate-pressure space (S2) to a position at which the helical groove (41) is covered with the edge portion of the second envelope portion (12). When the screw rotor (40) further rotates thereafter, and the sealing surface (44) of the helical groove (41) is covered with the second envelope portion (12) at a position behind the through hole (36) (upper position in FIG. 12), the second compression chamber (22) is fully closed.

The through hole (36) formed in the second envelope portion (12) as described above makes the second compression chamber (22) fully closed by the second gate rotor (60) at later timing than when the first compression chamber (21) is fully closed by the first gate rotor (50). As a result, the volume of the first compression chamber (21) is greater than the volume of the second compression chamber (22). It is preferable that the position of the through hole (36) in the second envelope portion (12) is set such that the volume of the first compression chamber (21) is about two to three times the volume of the second compression chamber (22).

Advantages of Second Embodiment

According to a feature of this embodiment, the second envelope portion (12) has the opening (35). It is thus possible to set the volume ratio between the first compression chamber (21) and the second compression chamber (22) appropriately by changing the timing of full closure of the first compression chamber (21) and the timing of full closure of the second compression chamber (22).

According to a feature of this embodiment, the opening (35) is a through hole (36) formed in the second envelope portion (12). The through hole (36) formed in the second envelope portion (12) makes it possible to set the volume ratio between the first compression chamber (21) and the second compression chamber (22) appropriately.

Third Embodiment

Figure 13:
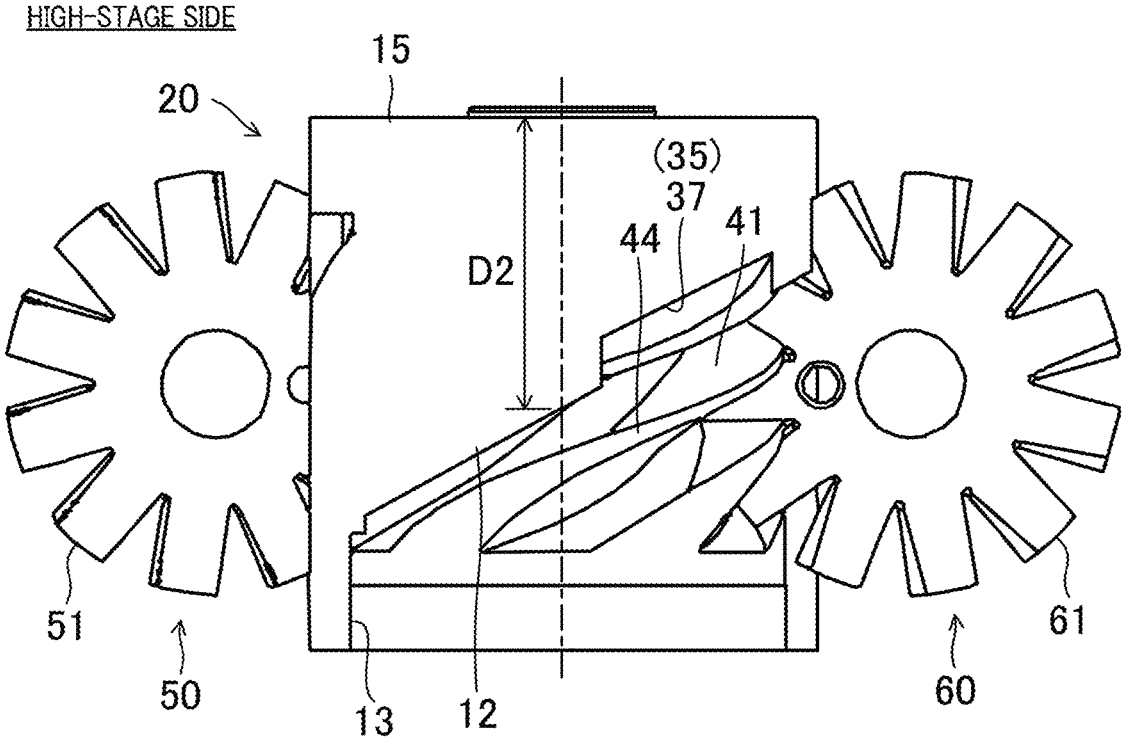
FIG. 13 is a plan view illustrating a configuration of a second envelope portion in a screw compressor according to a third embodiment.

In the example illustrated in FIG. 13, the axial length (D2) of the second envelope portion (12) is set to be equal to the axial length (D1) of the first envelope portion (11) (see FIG. 5).

The second envelope portion (12) has an opening (35) passing through the second envelope portion (12) from the inner surface to the outer surface of the second envelope portion (12). The opening (35) is a cut-out (37) formed in an edge portion of the second envelope portion (12). The cut-out (37) is formed at a position in the edge portion of the second envelope portion (12) near the second gate rotor (60) and extends in a circumferential direction.

Here, the refrigerant flows out to the intermediate-pressure space (S2) from the cut-out (37) even when the second compression chamber (22) in the suction phase moves from a position at which the helical groove (41) faces the intermediate-pressure space (S2) to a position at which the helical groove (41) is covered with the second envelope portion (12). When the screw rotor (40) further rotates thereafter, and the helical groove (41) is covered with the second envelope portion (12) at a position behind the cut-out (37) (upper position in FIG. 13), the second compression chamber (22) is fully closed.

The cut-out (37) formed in the second envelope portion (12) as described above makes the second compression chamber (22) fully closed by the second gate rotor (60) at later timing than when the first compression chamber (21) is fully closed by the first gate rotor (50). As a result, the volume of the first compression chamber (21) is greater than the volume of the second compression chamber (22). It is preferable that the position of the cut-out (37) in the second envelope portion (12) is set such that the volume of the first compression chamber (21) is about two to three times the volume of the second compression chamber (22).

Advantages of Third Embodiment

According to a feature of this embodiment, the opening (35) is the cut-out (37) formed in the edge portion of the second envelope portion (12). The cut-out (37) formed at the edge portion of the second envelope portion (12) makes it possible to set the volume ratio between the first compression chamber (21) and the second compression chamber (22) appropriately.

Fourth Embodiment

Figure 14:
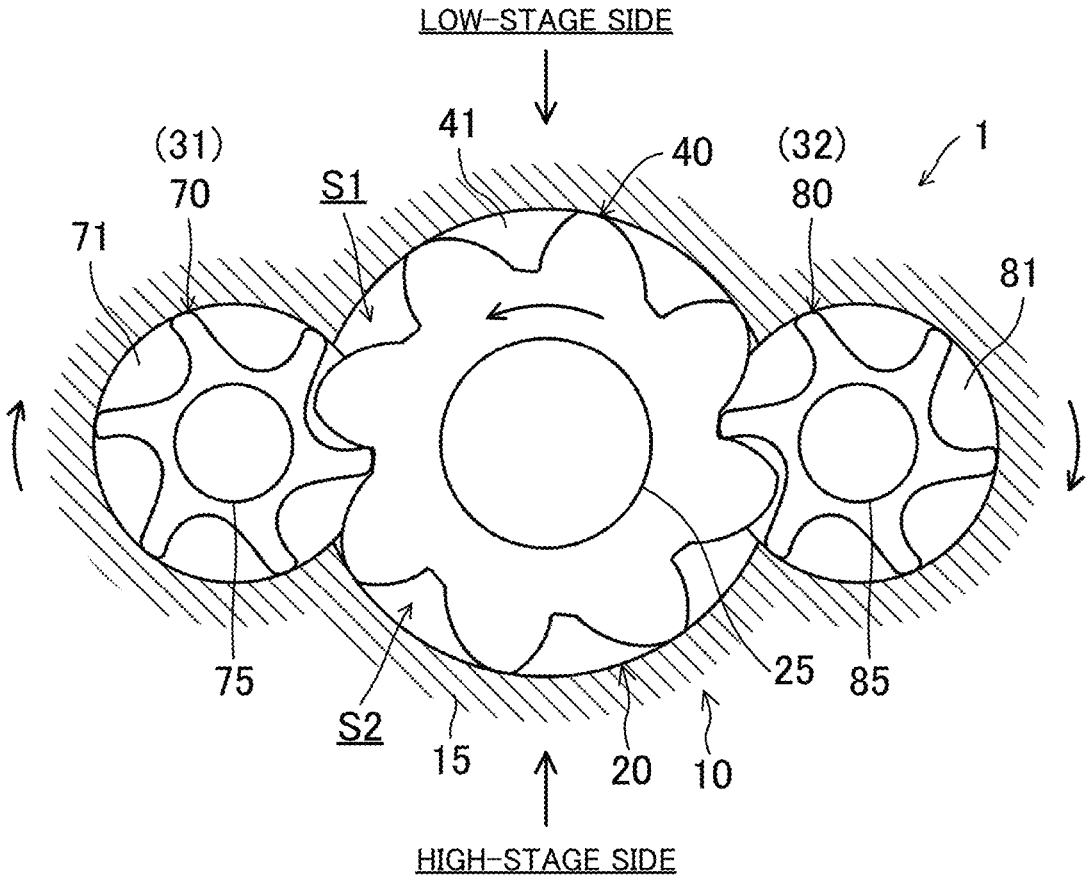
FIG. 14 is a cross-sectional view illustrating a configuration of a screw compressor according to a fourth embodiment.
Figure 15:
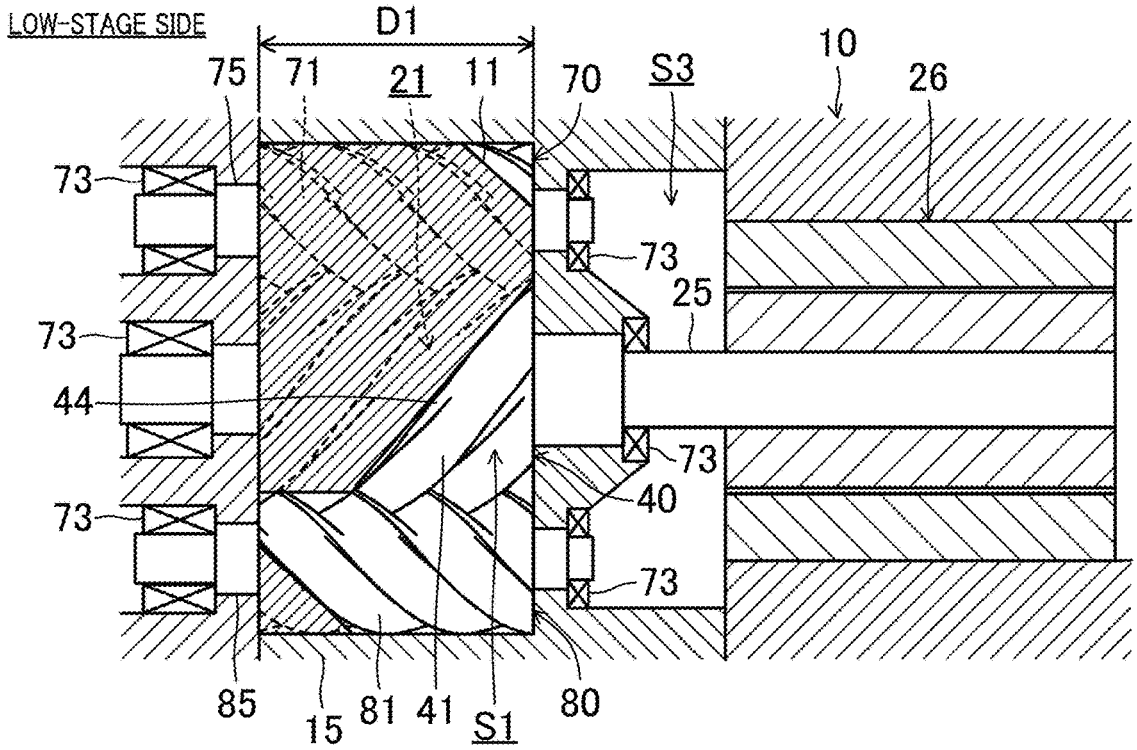
FIG. 15 is a plan view illustrating a configuration of a first envelope portion.
Figure 16:
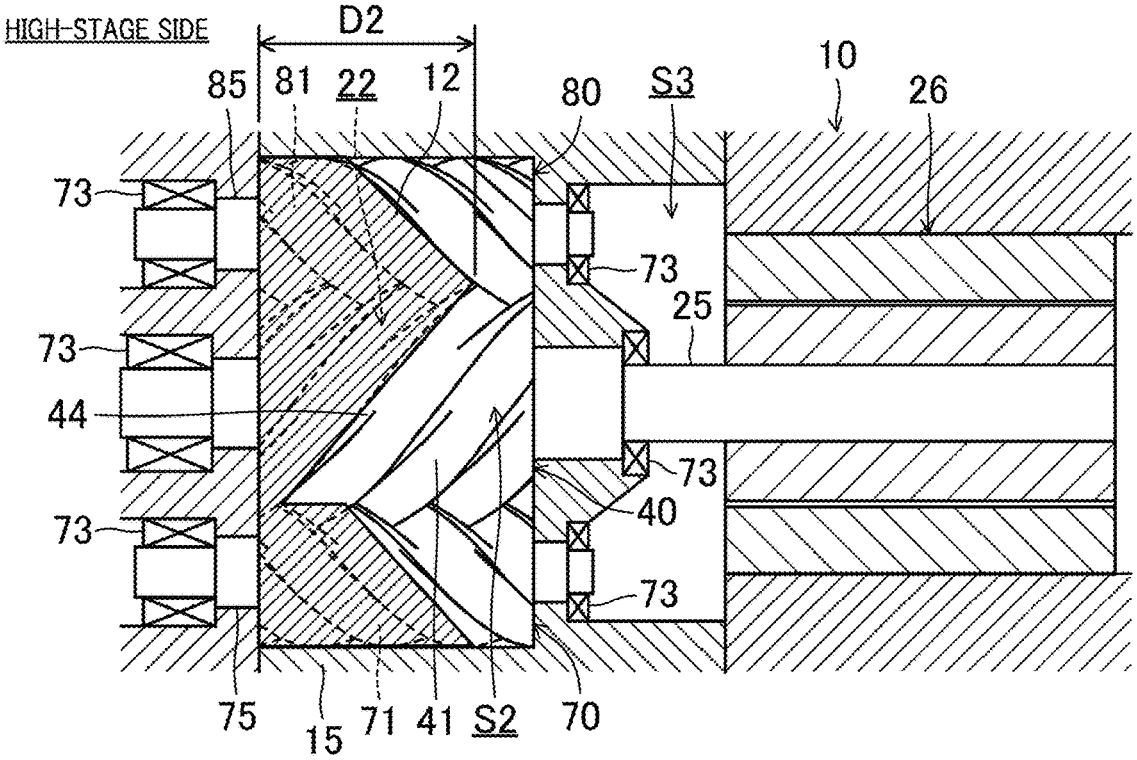
FIG. 16 is a plan view illustrating a configuration of a second envelope portion.

As illustrated in FIGS. 14 to 16, a screw compressor (1) includes a casing (10) and a compression mechanism (20). The casing (10) houses the compression mechanism (20). The compression mechanism (20) is coupled to a motor (26) via a drive shaft (25).

The compression mechanism (20) has a partition wall (15) provided in the casing (10), one screw rotor (40), a first rotor (31), and a second rotor (32). The first rotor (31) is configured as a first female rotor (70) having a plurality of first helical grooves (71). The second rotor (32) is configured as a second female rotor (80) having a plurality of second helical grooves (81). The screw rotor (40) is configured as one male rotor that meshes with the first female rotor (70) and the second female rotor (80). The screw compressor (1) of this embodiment is a so-called tri-rotor compressor.

The screw rotor (40), the first female rotor (70), and the second female rotor (80) are fitted into the partition wall (15). The partition wall (15) covers the outer peripheral surfaces of the screw rotor (40), the first female rotor (70), and the second female rotor (80). The first female rotor (70) and the second female rotor (80) mesh with the screw rotor (40). The drive shaft (25) of the screw rotor (40) is rotatably supported via a bearing (73). The first female rotor (70) has a first shaft (75) rotatably supported via another bearing (73). The second female rotor (80) has a second shaft (85) rotatably supported via still another bearing (73).

As illustrated in FIGS. 15 and 16, the partition wall (15) includes a first envelope portion (11) and a second envelope portion (12). In the compression mechanism (20), a space surrounded by the inner peripheral surface of the first envelope portion (11), the helical grooves (41) of the screw rotor (40), the walls of the first helical grooves (71) of the first female rotor (70), and the walls of the second helical grooves (81) of the second female rotor (80) is a first compression chamber (21). In the compression mechanism (20), a space surrounded by the inner peripheral surface of the second envelope portion (12), the helical grooves (41) of the screw rotor (40), the walls of the first helical grooves (71) of the first female rotor (70), and the walls of the second helical grooves (81) of the second female rotor (80) is a second compression chamber (22).

The first compression chamber (21) is a compression chamber on a low-stage side in two-stage compression, and compresses the refrigerant introduced into the casing (10) at a suction pressure to an intermediate pressure higher than the suction pressure. The second compression chamber (22) is a compression chamber on a high-stage side in the two-stage compression, and compresses the refrigerant at the intermediate pressure to a discharge pressure higher than the intermediate pressure.

The casing (10) includes therein the low-pressure space (S1) communicating with the suction side of the first compression chamber (21), the intermediate-pressure space (S2) communicating with the discharge side of the first compression chamber (21) and the suction side of the second compression chamber (22), and the high-pressure space (S3) communicating with the discharge side of the second compression chamber (22).

As described above, the low-pressure space (S1), the first compression chamber (21), the intermediate-pressure space (S2), the second compression chamber (22), and the high-pressure space (S3) are connected together in the order of the pressure of the fluid from low pressure to high pressure.

The first envelope portion (11) is configured to isolate the first compression chamber (21) from the low-pressure space (S1) on its outer peripheral side before the first compression chamber (21) reaches, during the rotation of the screw rotor (40), a suction shut-off position where the first compression chamber (21) is fully closed by the first female rotor (70) and the second female rotor (80).

An edge portion of the first envelope portion (11) is shaped to draw a curve parallel to the edge portion of a circumferential sealing surface (44) of the screw rotor (40). In other words, the edge portion of the first envelope portion (11) is shaped so that the entire length of the edge portion can overlap with the circumferential sealing surface (44) which moves along with the rotation of the screw rotor (40).

The second envelope portion (12) is configured to isolate the second compression chamber (22) from the intermediate-pressure space (S2) on its outer peripheral side before the second compression chamber (22) reaches, during the rotation of the screw rotor (40), a suction shut-off position where the second compression chamber (22) is fully closed by the first female rotor (70) and the second female rotor (80).

An edge portion of the second envelope portion (12) is shaped to draw a curve parallel to the edge portion of the circumferential sealing surface (44) of the screw rotor (40). In other words, the edge portion of the second envelope portion (12) is shaped so that the entire length of the edge portion can overlap with the circumferential sealing surface (44) which moves along with the rotation of the screw rotor (40).

In this embodiment, the axial length (D1) of the first envelope portion (11) and the axial length (D2) of the second envelope portion (12) that extend along the drive shaft (25) of the screw rotor (40) are set to be different from each other. Specifically, the axial length (D1) of the first envelope portion (11) is greater than the axial length (D2) of the second envelope portion (12).

Thus, the timing when the first compression chamber (21) is fully closed by the first female rotor (70) and the second female rotor (80) is earlier than the timing when the second compression chamber (22) is fully closed by the first female rotor (70) and the second female rotor (80). As a result, the volume of the first compression chamber (21) is greater than the volume of the second compression chamber (22). It is preferable that the axial length (D1) of the first envelope portion (11) and the axial length (D2) of the second envelope portion (12) are set such that the volume of the first compression chamber (21) is about two to three times the volume of the second compression chamber (22).

As can be seen, it is possible to set the volume ratio between the first compression chamber (21) and the second compression chamber (22) appropriately by changing the timing of full closure of the first compression chamber (21) and the timing of full closure of the second compression chamber (22).

Advantages of Fourth Embodiment

According to a feature of this embodiment, it is possible to set the volume ratio between the first compression chamber (21) and the second compression chamber (22) appropriately in the screw compressor (1) including the single screw rotor (40) (male rotor), the first female rotor (70), and the second female rotor (80).

Other Embodiments

The above-described embodiments may be modified as follows.

The configuration and shape of the first gate rotor (50) and the ratio between the number of grooves of the screw rotor (40) and the number of teeth of the first gate rotor (50) described in the above embodiments are not limited thereto, and may be changed.

In the above embodiments, fully closed timing in the tri-rotor screw compressor (1) is changed by setting the axial length (D1) of the first envelope portion (11) and the axial length (D2) of the second envelope portion (12) to be different from each other, but not limited thereto.

For example, the axial length (D1) of the first envelope portion (11) and the axial length (D2) of the second envelope portion (12) may be set to be equal to each other, and the second envelope portion (12) may have a through hole (36) (see FIG. 12) or a cut-out (37) (see FIG. 13) as the opening (35), thereby changing the fully closed timing.

While the embodiments and variations have been described above, it will be understood that various changes in form and details can be made without departing from the spirit and scope of the claims. The elements according to the embodiments, the variations thereof, and the other embodiments may be combined and replaced with each other. In addition, the expressions of "first," "second," "third," . . . , in the specification and claims are used to distinguish the terms to which these expressions are given, and do not limit the number and order of the terms.

As described above, the present disclosure is useful for a screw compressor and a refrigeration apparatus.

The invention claimed is:

1. A screw compressor comprising:

a screw rotor having a plurality of helical grooves;

a first rotor configured to mesh with the helical grooves of the screw rotor;

a second rotor configured to mesh with the helical grooves of the screw rotor; and a casing having a partition wall, the partition wall rotatably retaining the screw rotor and covering an outer peripheral surface of the screw rotor, the partition wall including a first envelope portion to form a first compression chamber, and a second envelope portion to form a second compression chamber, the first compression chamber being formed inside the first envelope portion by the screw rotor and the first rotor, and the first compression chamber compressing a fluid introduced into the casing with a suction pressure to an intermediate pressure higher than the suction pressure, the second compression chamber being formed inside the second envelope portion by the screw rotor and the second rotor, and the second compression chamber compressing the fluid with the intermediate pressure to a discharge pressure higher than the intermediate pressure, an axial length of the first envelope portion and an axial length of the second envelope portion that extend along a drive shaft of the screw rotor being different from each other, and the axial length of the first envelope portion being greater than the axial length of the second envelope portion.

2. The screw compressor of claim 1, wherein the first rotor is configured as a first gate rotor including a plurality of first gates arranged radially, the second rotor is configured as a second gate rotor including a plurality of second gates arranged radially, and the first gates and the second gates mesh with the helical grooves of the single screw rotor.

3. The screw compressor of claim 2, wherein a first shaft of the first gate rotor and a second shaft of the second gate rotor are substantially orthogonal to a phantom plane extending along the drive shaft of the screw rotor.

4. The screw compressor of claim 1, wherein the first rotor is configured as a first female rotor having a plurality of first helical grooves, the second rotor is configured as a second female rotor having a plurality of second helical grooves, and the screw rotor is configured as one male rotor that meshes with the first female rotor and the second female rotor.

5. A refrigeration apparatus including the screw compressor of claim 1, the refrigeration apparatus further comprising:

a refrigerant circuit through which a refrigerant compressed by the screw compressor flows.

6. A screw compressor comprising:

a screw rotor having a plurality of helical grooves;

a first rotor configured to mesh with the helical grooves of the screw rotor;

a second rotor configured to mesh with the helical grooves of the screw rotor; and a casing having a partition wall, the partition wall rotatably retaining the screw rotor and covering an outer peripheral surface of the screw rotor, the partition wall including a first envelope portion to form a first compression chamber, and a second envelope portion to form a second compression chamber, the first compression chamber being formed inside the first envelope portion by the screw rotor and the first rotor, and the first compression chamber compressing a fluid introduced into the casing with a suction pressure to an intermediate pressure higher than the suction pressure, the second compression chamber being formed inside the second envelope portion by the screw rotor and the second rotor, and the second compression chamber compressing the fluid with the intermediate pressure to a discharge pressure higher than the intermediate pressure, and the second envelope portion having an opening passing through the second envelope portion from an inner surface to an outer surface of the second envelope portion so that the second compression chamber is fully closed by the second rotor at later timing than when the first compression chamber is fully closed by the first rotor.

7. The screw compressor of claim 6, wherein the opening is a through hole formed in the second envelope portion.

8. The screw compressor of claim 6, wherein the opening is a cut-out formed in an edge portion of the second envelope portion.

9. The screw compressor of claim 6, wherein the first rotor is configured as a first gate rotor including a plurality of first gates arranged radially, the second rotor is configured as a second gate rotor including a plurality of second gates arranged radially, and the first gates and the second gates mesh with the helical grooves of the single screw rotor.

10. The screw compressor of claim 9, wherein a first shaft of the first gate rotor and a second shaft of the second gate rotor are substantially orthogonal to a phantom plane extending along the drive shaft of the screw rotor.

11. The screw compressor of claim 6, wherein the first rotor is configured as a first female rotor having a plurality of first helical grooves, the second rotor is configured as a second female rotor having a plurality of second helical grooves, and the screw rotor is configured as one male rotor that meshes with the first female rotor and the second female rotor.

12. A refrigeration apparatus including the screw compressor of claim 6, the refrigeration apparatus further comprising:

a refrigerant circuit through which a refrigerant compressed by the screw compressor flows.

* * * * *